US011756720B2

(12) United States Patent
Lee et al.

(10) Patent No.: US 11,756,720 B2
(45) Date of Patent: Sep. 12, 2023

(54) COIL COMPONENT

(71) Applicant: SAMSUNG ELECTRO-MECHANICS CO., LTD., Suwon-si (KR)

(72) Inventors: Seung Min Lee, Suwon-si (KR); Ju Hwan Yang, Suwon-si (KR); Yoon Mi Cha, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 547 days.

(21) Appl. No.: 16/834,274

(22) Filed: Mar. 30, 2020

(65) Prior Publication Data

US 2020/0402700 A1 Dec. 24, 2020

(30) Foreign Application Priority Data

Jun. 24, 2019 (KR) ..... 10-2019-0075124

(51) Int. Cl.
*H01F 27/28* (2006.01)
*H01F 27/24* (2006.01)
(Continued)

(52) U.S. Cl.
CPC ..... *H01F 27/2804* (2013.01); *H01F 17/0006* (2013.01); *H01F 27/24* (2013.01);
(Continued)

(58) Field of Classification Search
CPC ..... H01F 17/0013; H01F 2027/2809; H01F 17/0006; H01F 27/2804; H01F 5/003;
(Continued)

(56) References Cited

U.S. PATENT DOCUMENTS

2014/0009254 A1 1/2014 Ohkubo et al.
2015/0102891 A1* 4/2015 Yoon ..... H01F 27/2804 336/200
(Continued)

FOREIGN PATENT DOCUMENTS

JP 2018019059 A * 2/2018 ..... H01F 17/0013
JP 2018-174306 A 11/2018
(Continued)

OTHER PUBLICATIONS

Office Action issued in corresponding Korean Patent Application No. 10-2019-0075124 dated Jun. 11, 2020, with English translation.

*Primary Examiner* — Tszfung J Chan
(74) *Attorney, Agent, or Firm* — MORGAN, LEWIS & BOCKIUS LLP

(57) ABSTRACT

A coil component includes a coil portion embedded in a body, first and second lead-out portions connection to both end of the coil portion, respectively, and exposed from one surface of the body to be spaced apart from each other, and a support substrate supporting the coil portion and the first and second lead-out portions, and exposed from the one surface of the body. Each of the first and second lead-out portions includes a lead-out pattern and an auxiliary lead-out pattern disposed on one surface and the other surface of the support substrate, opposing each other, and exposed from the one surface of the body, respectively, and a connection via penetrating through the support substrate to connect the lead-out pattern and the auxiliary lead-out pattern to each other, and exposed from the one surface of the body.

19 Claims, 4 Drawing Sheets

(51) Int. Cl.

| | |
|---|---|
| ***H01F 27/32*** | (2006.01) |
| ***H01F 27/29*** | (2006.01) |
| ***H01F 27/30*** | (2006.01) |
| ***H01F 17/00*** | (2006.01) |

(52) U.S. Cl.
CPC ..... *H01F 27/2828* (2013.01); *H01F 27/292* (2013.01); *H01F 27/306* (2013.01); *H01F 27/327* (2013.01); *H01F 2017/002* (2013.01); *H01F 2027/2809* (2013.01)

(58) Field of Classification Search
CPC .. H01F 27/29; H01F 27/292; H01F 2017/002; H01F 27/2828; H01F 27/306
USPC ..... 336/200, 232
See application file for complete search history.

(56) References Cited

U.S. PATENT DOCUMENTS

| | | | | |
|---|---|---|---|---|
| 2017/0236633 | A1* | 8/2017 | Park | H01F 17/04 336/55 |
| 2018/0012696 | A1 | 1/2018 | Lee et al. | |
| 2018/0286561 | A1 | 10/2018 | Shimoichi | |
| 2018/0315541 | A1* | 11/2018 | Okura | H01F 27/29 |

FOREIGN PATENT DOCUMENTS

| | | | | | |
|---|---|---|---|---|---|
| JP | 2018174306 | A | * | 11/2018 | H01F 17/0013 |
| KR | 10-2014-0005088 | A | | 1/2014 | |
| KR | 2014137306 | A | * | 12/2014 | |
| KR | 10-2018-0006246 | A | | 1/2018 | |
| KR | 10-2018-0012621 | A | | 2/2018 | |

* cited by examiner

COIL COMPONENT

CROSS-REFERENCE TO RELATED APPLICATION(S)

This application claims benefit of priority to Korean Patent Application No. 10-2019-0075124 filed on Jun. 24, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used together with a resistor and a capacitor in electronic devices.

In accordance with the implementation of high performance and miniaturization in electronic devices, coil components used in electronic devices have increased in number and decreased in size.

In the case of a general thin film type inductor, a lead-out portion of a coil and a support substrate are exposed together on a surface of a body, and an external electrode covering the lead-out portion of the coil and the support substrate is formed on the surface of the body.

When the external electrode is formed on the surface of the body by plating, it may be difficult to form the external electrode with a uniform thickness due to difference in conductivity between the lead-out portion of the coil and the support substrate.

SUMMARY

An aspect of the present disclosure is to provide a coil component in which external electrodes may be formed by plating relatively uniformly on a body surface.

According to an aspect of the present disclosure, there is provided a coil component. The coil component includes a coil portion embedded in a body; first and second lead-out portions connected to both ends of the coil portion, respectively, and exposed from one surface of the body to be spaced apart from each other; and a support substrate embedded in the body to support the coil portion and the first and second lead-out portions, and exposed from the one surface of the body. Each of the first and second lead-out portions includes a lead-out pattern and an auxiliary lead-out pattern disposed on one surface and the other surface, opposing each other, and a connection via penetrating through the support substrate to connect the lead-out pattern and the auxiliary lead-out pattern to each other and exposed from the one surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
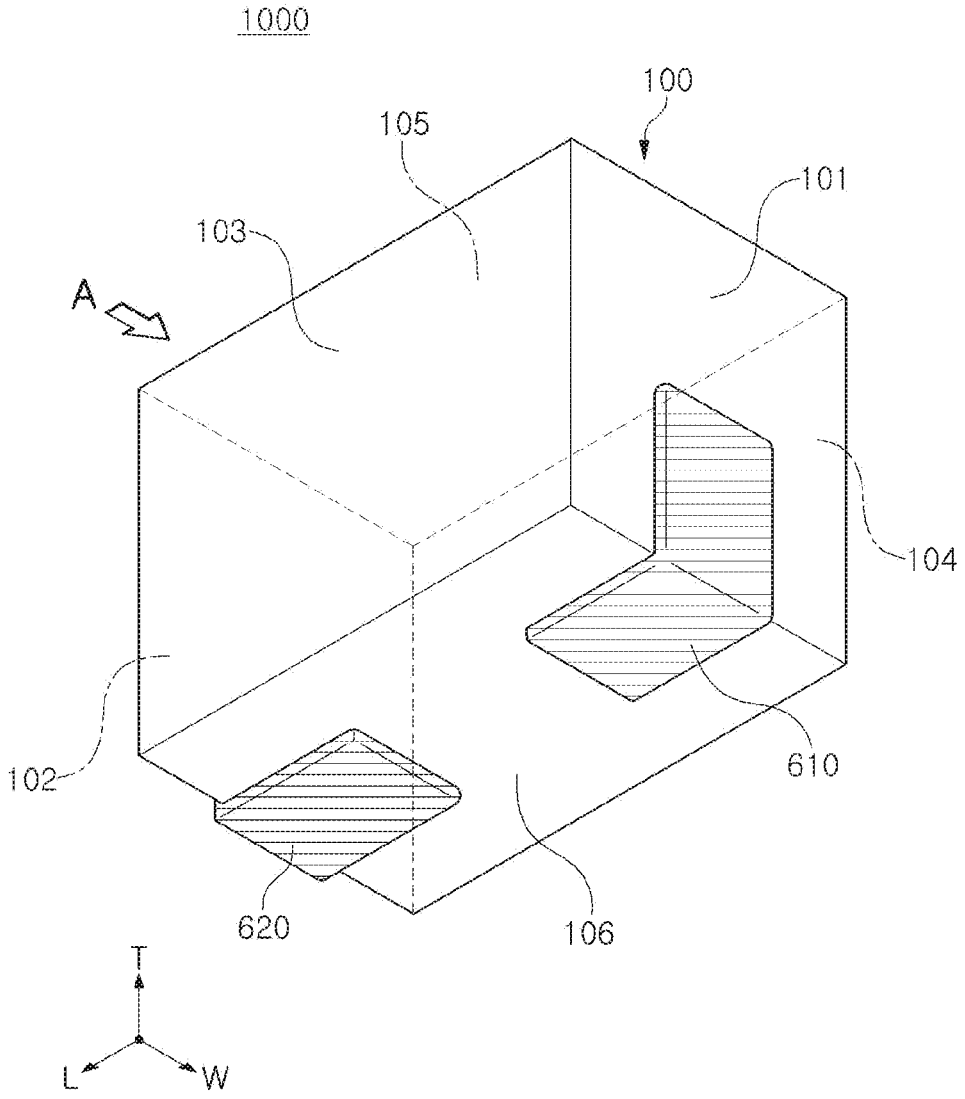
FIGS. 1 and 2 are views schematically illustrating a coil component according to an embodiment of the present disclosure, respectively, viewed from below.

Hereinafter, embodiments of the present disclosure will be described as follows with reference to the attached drawings. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or the like.

In other words, in electronic devices, a coil component may be used as a power inductor, a high frequency (HF) inductor, a general bead, a high frequency (GHz) bead, a common mode filter, and the like.

Figure 2:
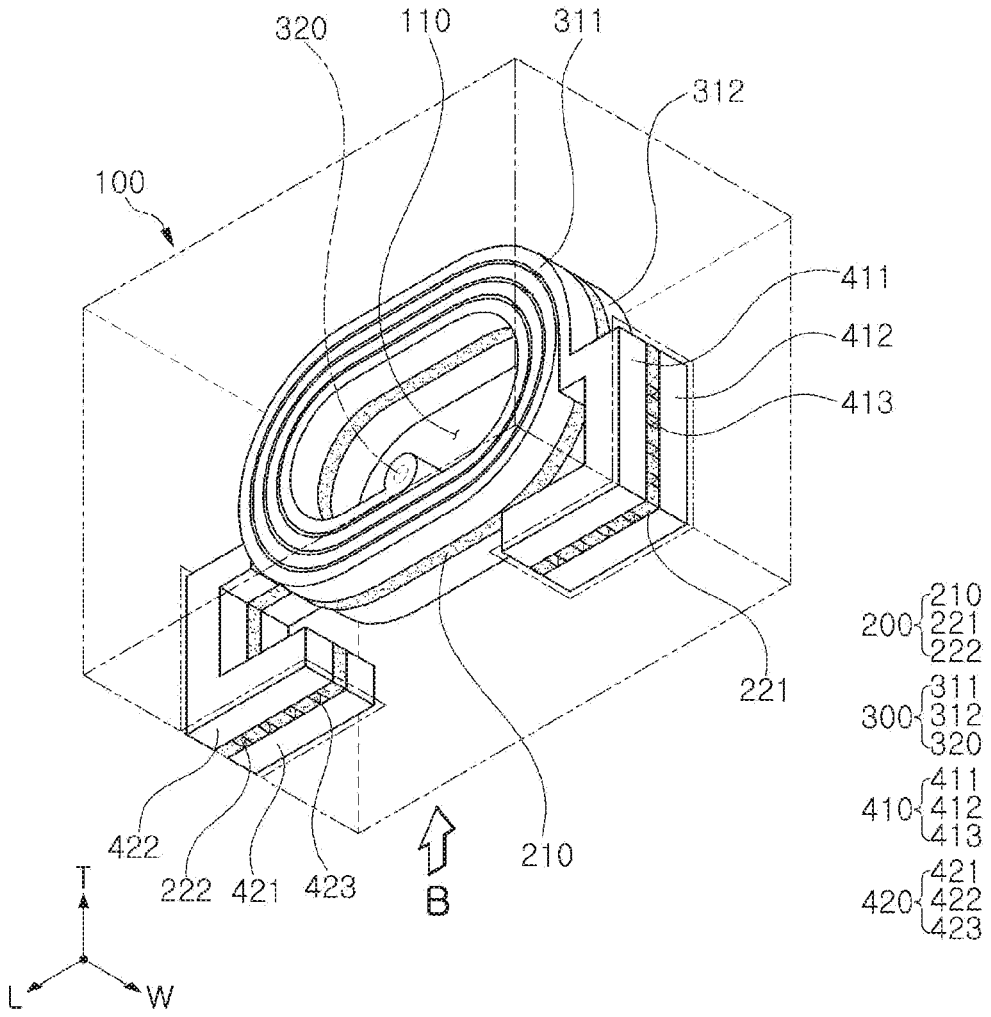
Figure 3:
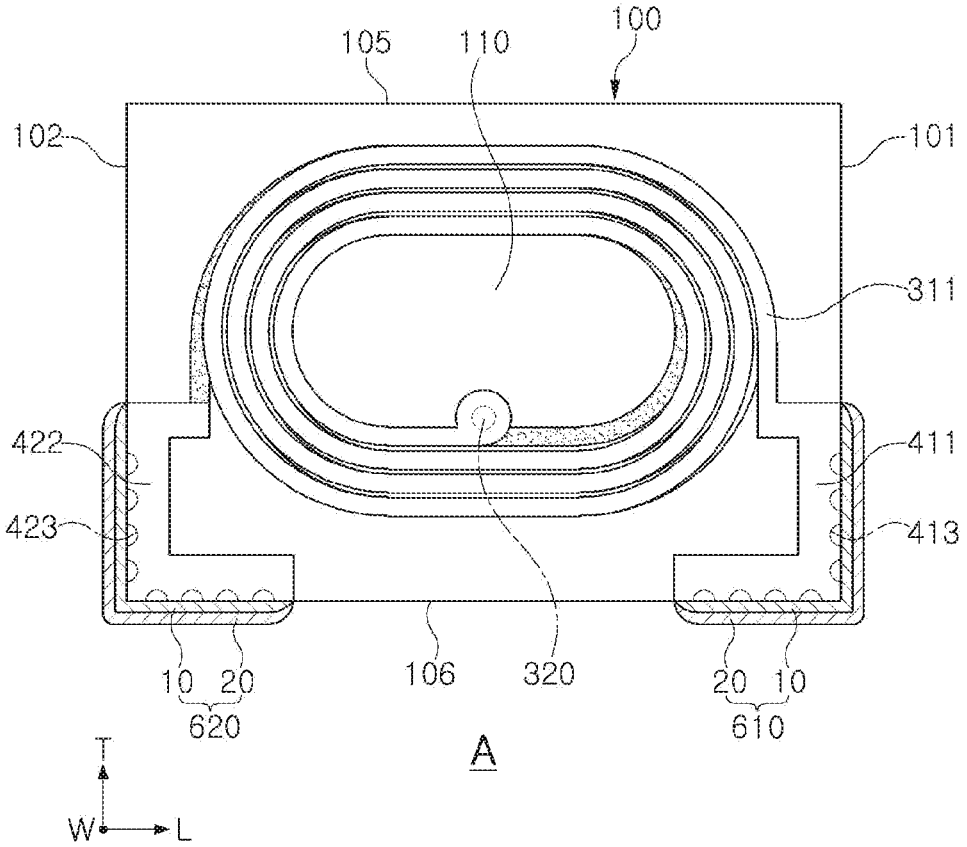
FIG. 3 is a view schematically illustrating what is viewed in direction A of FIG. 1.
Figure 4:
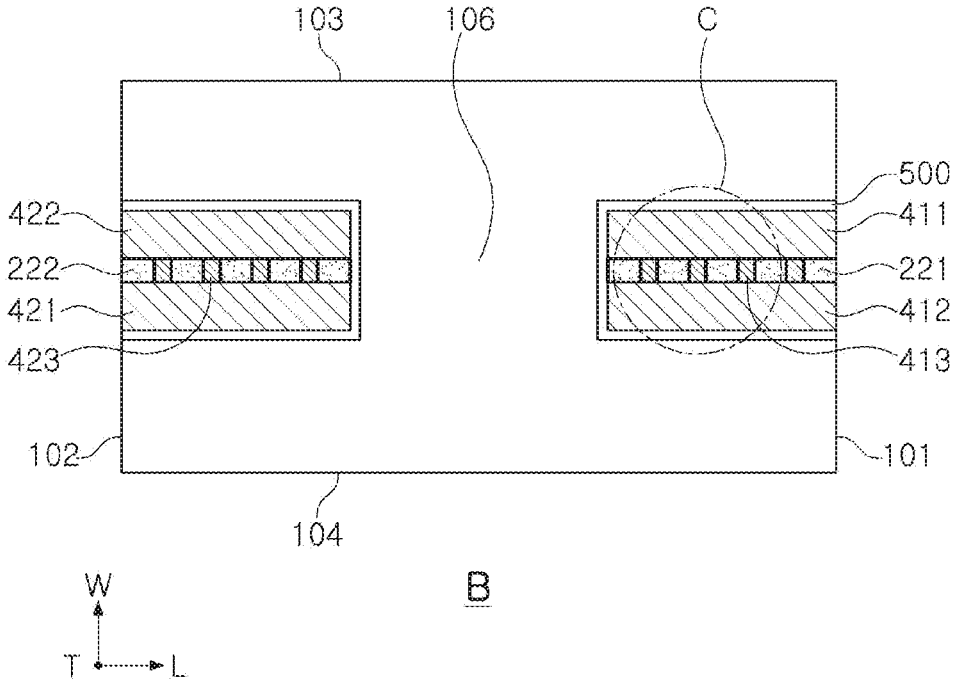
FIG. 4 is a view schematically illustrating what is viewed in direction B of FIG. 2.
Figure 5:
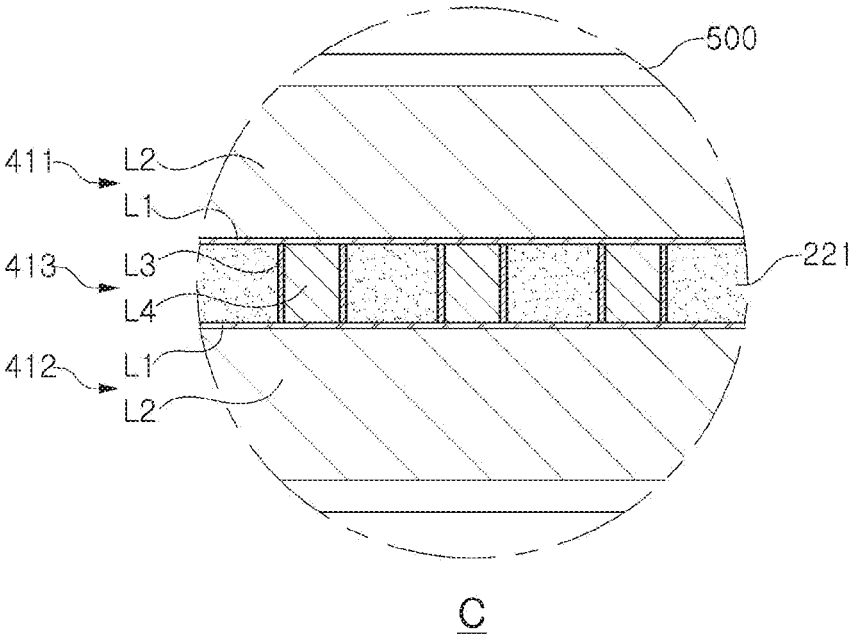
FIG. 5 is a view schematically illustrating an enlarged view of region C of FIG. 4.
Figure 6:
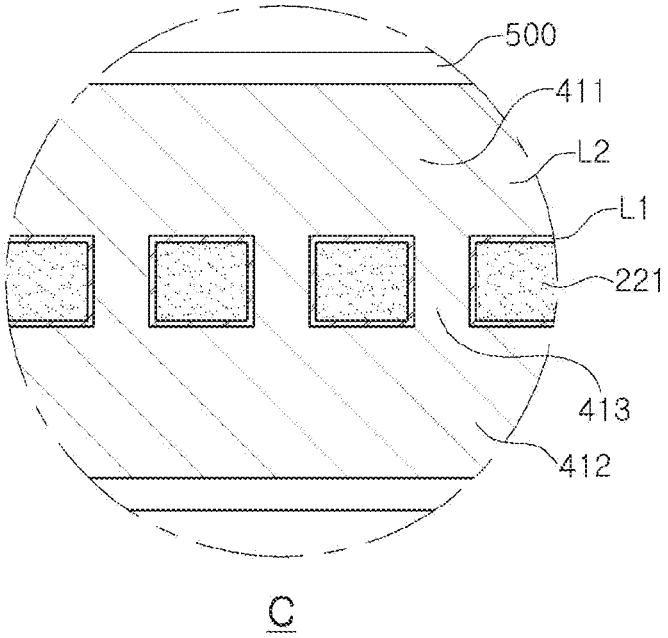
FIG. 6 is a view schematically illustrating an enlarged view of region C of FIG. 4 according to a modified example of FIG. 5.

FIGS. 1 and 2 are views schematically illustrating a coil component according to an embodiment of the present disclosure, respectively, viewed from below. FIG. 3 is a view schematically illustrating what is viewed in direction A of FIG. 1. FIG. 4 is a view schematically illustrating what is viewed in direction B of FIG. 2. FIG. 5 is a view schematically illustrating an enlarged view of region C of FIG. 4. FIG. 6 is a view schematically illustrating an enlarged view of region C of FIG. 4 according to a modified example of FIG. 5.

Meanwhile, for the sake of understanding and explanation, FIG. 1 mainly illustrates an exterior of a coil component according to the present embodiment, and FIG. 2 mainly illustrates an internal structure of a coil component according to the present disclosure. In addition, for ease of understanding and explanation, FIG. 2 omits external electrodes and illustrates a part of configuration applied to the present disclosure. In order to facilitate understanding, FIG. 3 mainly illustrates an internal structure, when viewed from the direction A of FIG. 1.

Referring to FIGS. 1 to 6, a coil component 1000 according to a first embodiment of the present disclosure may include a body 100, a support substrate 200, a coil portion 300, a first lead-out portion 410, and a second lead-out portion 420, and may further include an insulating film 500 and external electrodes 610 and 620.

The body 100 may form an exterior of the coil component 1000 according to the present embodiment, and may embed the coil portion 300 therein.

The body 100 may have a hexahedral shape as a whole.

Referring to FIGS. 1 and 2, the body 100 includes a first surface 101 and a second surface 102, opposing each other in a length direction L, a third surface 103 and a fourth surface 104, opposing each other in a width direction W, and a fifth surface 105 and a sixth surface 106, opposing each other in a thickness direction T. Each of the first to fourth surfaces 101, 102, 103, and 104 of the body 100 may correspond to a wall surface of the body 100 connecting the fifth surface 105 and the sixth surface 106 of the body 100. In the description below, one end surface and the other end surface of the body 100 may refer to the first surface 101 and the second surface 102 of the body 100, respectively, and one surface and the other surface of the body 100 may refer to the sixth surface 106 and the fifth surface 105 of the body 100, respectively.

As an example, the body 100 may be formed such that the coil component 100 according to the present embodiment in which external electrodes 610 and 620 are formed to be described later has a length of 1.0 mm, a width of 0.6 mm, and a thickness of 0.8 mm, but is not limited thereto. Meanwhile, since the numerical values described above are merely numerical values on design that do not reflect process errors and the like, it should be considered that they are within the scope of the present disclosure to an extent that process errors may be recognized.

However, the body 100 may include a magnetic material and a resin. As a result, the body 100 has magnetic properties. The body 100 may be formed by laminating one or more magnetic composite sheets including a resin and a magnetic material dispersed in a resin. However, the body 100 may have a structure different from the structure in which a magnetic material is dispersed in a resin. For example, the body 100 may be formed of a magnetic material such as a ferrite.

The magnetic material may be a ferrite or a magnetic metal powder.

The ferrite powder may include, for example, at least one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more elements selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more materials among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but is not limited thereto.

The ferrite and the magnetic metal powder may have an average diameter of about 0.1 μm to 30 μm, respectively, but is not limited thereto.

The body 100 may include two or more types of magnetic materials dispersed in a resin. Here, the notion that types of the magnetic materials are different may indicate that one of an average diameter, a composition, crystallinity, and a form of one of magnetic materials is different from those of the other magnetic materials.

The resin may include one of an epoxy, a polyimide, a liquid crystal polymer, or mixture thereof, but is not limited thereto.

The body 100 may include a core 110 penetrating through the coil portion 300 and the support substrate 200. The core 110 may be formed by filling a through hole of the coil portion 300 with a magnetic composite sheet, but is not limited thereto.

The support substrate 200 may be embedded in the body 100. Specifically, the support substrate 200 may be embedded in the body 100 to be perpendicular to, or substantially perpendicular to, one surface 106 of the body 100. Therefore, the coil portion 300 disposed on the support substrate 200 is disposed to be perpendicular to, or substantially perpendicular to, one surface 106 of the body 100. The term, "substantially," reflects consideration of recognizable process errors which may occur during manufacturing or measurement.

The support substrate 200 may include a support portion 210 and first and second end portions 221 and 222. The support portion 210 may support the coil portion 300 to be described later, and the first and second end portions 221 and 222 may support first and second lead-out portions 410 and 420 to be described later, respectively. The support portion 210 and the first and second end portions 221 and 222 may be integrally connected to each other. That is, the support portion 210 and the first and second end portions 221 and 222 may be integrally formed such that a boundary therebetween does not exist. The first end portion 221 may be exposed to the first surface 101 and the sixth surface 106 of the body 100, respectively. The second end portion 222 may be exposed to the second surface 102 and the sixth surface 106 of the body 100, respectively. The first and second end portions 221 and 222 may be exposed to the sixth surface 106 of the body 100 to be spaced apart from each other.

The support substrate 200 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the support substrate 200 may be formed of an insulating material such as prepreg, Ajinomoto Build-up Film (ABF), FR-4, a bismaleimide triazine (BT) resin, a photoimageable dielectric (PID), and the like, but is not limited thereto.

As an inorganic filler, at least one or more elements selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide improved stiffness. When the support substrate 200 is formed of an insulating material which does not include a glass fiber, the support substrate 200 may reduce an overall thickness of the coil portion 200 to reduce a width of the coil component 1000.

The coil portion 300 may be embedded in the body 100 to exhibit characteristics of the coil component. For example, when the coil component 1000 according to the present embodiment is used as a power inductor, the coil portion 300 may serve to stabilize power supply of electronic devices by storing an electric field as a magnetic field and maintaining an output voltage.

The coil portion 300 may be disposed on the support portion 210 of the support substrate 200. The coil portion 300 may be formed on at least one of both surfaces of the support portion 210, opposing each other, and may form at least one turn. In the case of the present embodiment, the coil portion 300 may include first and second coil patterns 311 and 312 disposed on both surfaces of the support portion 210, opposing each other in a width direction W of the body 100 and facing each other and a via 320 penetrating through the support portion 210 to connect innermost turns of each of the first and second coil patterns 311 and 312 to each other.

Each of the first coil pattern 311 and the second coil pattern 312 may have a planar spiral shape having at least one turn around the core 110 of the body 100. As an example, with reference to FIG. 2, the first coil pattern 311 may form a plurality of turns around the core 110 at a front surface of the support portion 210, and the second coil pattern 312 may form a plurality of turns around the core 110 at a rear surface of the support portion 210.

The first and second lead-out portions 410 and 420 may be connected to both ends of the coil portion 300, respectively, and may be exposed on the sixth surface 106 of the body 100 to be spaced apart from each other. The lead-out portions 410 and 420 may be exposed to the surface of the body 100 and may be connected to external electrodes 610 and 620 to be described later, respectively. Therefore, the coil portion 300 and the external electrodes 610 and 620 may be connected through the lead-out portions 410 and 420, respectively.

The lead-out portions 410 and 420 may respectively include lead-out patterns 411 and 421 disposed on one surface and the other surface of the support substrate 200, opposing each other, auxiliary lead-out patterns 412 and 422 disposed on one surface and the other surface of the support substrate 200, opposing each other, and connection vias 413 and 423 penetrating through the support substrate 200 to connect the lead-out patterns 411 and 421 and the auxiliary lead-out patterns 412 and 422 to each other, and exposed to the sixth surface 106 of the body 100. Specifically, the first lead-out portion 410 may include a first lead-out pattern 411 disposed on one surface of (a front surface of the first end portion 221 with respect to direction A of FIG. 2) and exposed to the sixth surface 106 of the body 100, a first auxiliary lead-out pattern 412 disposed on the other surface (a rear surface of the first end portion 221 with respect to direction A of FIG. 2) and exposed to the sixth surface 106 of the body 100, and a first connection via 413 penetrating through the first end portion 221 and connecting the first lead-out pattern 411 and the first auxiliary lead-out pattern 412 to each other, and exposed to the sixth surface 106 of the body 100. The second lead-out portion 420 may include a second auxiliary lead-out pattern 422 disposed on one surface (a front surface of the second end portion 222 with respect to direction A of FIG. 2) and exposed to the sixth surface 106 of the body 100, a second lead-out pattern 421 disposed on the other surface (a rear surface of the second end portion 222 with respect to direction A of FIG. 2) and exposed to the sixth surface 106 of the body 100, and a second connection via 423 penetrating through the second end portion 222 and connecting the second lead-out pattern 421 and the second auxiliary lead-out pattern 422 to each other, and exposed to the sixth surface 106 of the body 100. The first lead-out portion 410 may be continuously exposed to the first and sixth surfaces 101 and 106 of the body 100. The second lead-out portion 420 may be continuously exposed to the second and sixth surfaces 102 and 106 of the body 100. Specifically, each of the first lead-out pattern 411 and the first auxiliary lead-out pattern 412 may be continuously exposed to the first and sixth surfaces 101 and 106 of the body 100. Each of the second lead-out pattern 421 and the second auxiliary lead-out pattern 422 may be continuously exposed to the second and sixth surfaces 102 and 106 of the body 100. The first connection via 413 may be exposed to the first and sixth surfaces 101 and 106 of the body 100 in which the first lead-out pattern 411 and the first auxiliary lead-out pattern 412 are exposed. The second via 423 may be exposed to the second and sixth surfaces 102 and 106 of the body 100 in which the second lead-out pattern 421 and the second auxiliary lead-out pattern 42 are exposed. Each of the first and second connection vias 413 and 423 may be formed as a plurality thereof, spaced apart from each other, and may be exposed to the first, second, and sixth surfaces 101, 102, and 106 of the body.

The first coil pattern 311 and the first lead-out pattern 411 may be disposed together on one surface of the support substrate 200 and connected to each other. The second coil pattern 312 and the second lead-out pattern 421 may be disposed together on the other surface of the support substrate 200 and connected to each other. The first auxiliary lead-out pattern 412 and the second coil pattern 312 may be disposed on the other surface of the support substrate 200, and may be spaced apart from each other and may not be in contact with each other. The second auxiliary lead-out pattern 422 and the first coil pattern 311 may be disposed together on one surface of the support substrate 200 and may be spaced apart from each other and may not be in contact with each other. The first coil pattern 311 and the first lead-out pattern 411 may be integrally formed on one surface of the support substrate 200, but is not limited thereto. The second coil pattern 312 and the second lead-out pattern 421 may be integrally formed on the other surface of the support substrate 200, but is not limited thereto. The auxiliary lead-out patterns 412 and 422 may be disposed on the support substrate 200 in a shape corresponding to the lead-out patterns 411 and 421, respectively, and may be connected to the lead-out patterns 411 and 412 by connection vias 413 and 423, respectively. Therefore, in forming a plating layer of the external electrodes 610 and 620 on the exposed surfaces of the lead-out portions 410 and 420, plating growth occurs in not only the exposed surfaces of the lead-out patterns 411 and 421 but also the exposed surfaces of the auxiliary lead-out patterns 412 and 422. As a result, in the present embodiment, compared with the case in which the auxiliary lead-out patterns 412 and 422 are not formed or the case in which the auxiliary lead-patterns 412 and 422 are not exposed to the surface of the body 100, even the external electrodes 610 and 620 are formed by a plating process, the external electrodes 610 and 620 may be formed with a relatively uniform thickness. In addition, the plating layer of the external electrodes 610 and 620 may extend to the exposed surfaces of the first and second end portions 221 and 222 and plating time to cover the exposed surfaces of the first and second end portions 221 and 222 may be shortened.

The end portions 221 and 222, the lead-out patterns 411 and 421, and the auxiliary lead-out patterns 412 and 422 may be formed to correspond to each other. That is, the first end portion 221, the first lead-out pattern 411, and the first auxiliary lead-out pattern 412 may be formed to correspond to each other, and the second end portion 222, the second lead-out pattern 421, and the second auxiliary lead-out pattern 422 may be formed to correspond to each other.

Each of the lead-out patterns 411 and 412 and the auxiliary lead-out patterns 412 and 422 may be exposed to one surface 106 of the body 100 with a length corresponding to the support substrate 200. That is, the first lead-out pattern 411 and the first auxiliary lead-out pattern 412 may be exposed to the sixth surface 106 of the body 100 with a length corresponding to the first end portion 221. The second lead-out pattern 421 and the first auxiliary lead-out pattern 422 may be exposed to the sixth surface 106 of the body 100 with a length corresponding to the second end portion 222. Since the lead-out patters 411 and 421 and the auxiliary lead-out patterns 412 and 422 are exposed to correspond to a length of the exposed surface of the support substrate 200, the external electrodes 610 and 620 formed by the plating process may be formed to be more flat. Thus, external defects of the external electrodes 610 and 620 may be reduced.

The connection via 413 may penetrate through the end portion 221 and may connect the lead-out pattern 411 and the auxiliary lead-out pattern 412 to each other. The connection via 423 may penetrate through the end portion 222 and may connect the lead-out pattern 421 and the auxiliary lead-out pattern 422 to each other. The connection vias 413 and 423 may be exposed on the sixth surface 106 of the body 100. Therefore, the connection vias 413 and 423 may reduce the exposed areas of the end portions 221 and 222 exposed to the sixth surface 106 of the body 100. In forming the external electrodes 610 and 620 on the sixth surface 106 of the body 100 by plating, the exposed surfaces of the end portions 221 and 222 may be interposed between the exposed surfaces of the lead-out patterns 411 and 421 and the exposed surfaces of the auxiliary lead-out patterns 412 and 422. A plating layer may be grown on the exposed surfaces of the lead-out patterns 411 and 421 and the auxiliary lead-out patterns 412 and 422 because the lead-out patterns 411 and 421 and the auxiliary lead-out patterns 412 and 422 are conductors. However, a plating layer may not be grown from the exposed surfaces of the end portions 221 and 222, since the end portions 221 and 222 are non-conductors. In this case, the plating layers of the external electrodes 610 and 620 may be formed in such a manner that deviation between the thickness of regions disposed on the exposed surface of the lead-out patterns 411 and 421 and the auxiliary lead-out patterns 412 and 422 and the thickness of regions disposed on the exposed surfaces of the end portions 221 and 222 is large. In the present embodiment, the exposed areas of the end portions 221 and 222 may be reduced by the connection vias 413 and 423 penetrating through the end portions 221 and 222. Therefore, the thickness deviation of the plating layer of the external electrode described above may be significantly reduced. Further, since the connection vias 413 and 423 are conductors, and the plating layer may also be grown on the exposed surfaces of the connection vias 413 and 423, the plating layers of the external electrodes 610 and 620 may extend on the exposed surfaces of the end portions 221 and 222 to shorten time required to the entire exposed surfaces of the end portions 221 and 222.

The connection vias 413 and 423 may be formed as a plurality thereof, and at least two or more of the plurality of connection vias 413 and 423 may be exposed to one surface 106 of the body 100 to be spaced apart from each other. Specifically, the first connection via 413 connecting the first lead-out pattern 411 and the first auxiliary lead-out pattern 412 may be formed as a plurality thereof in the first end portion 221 and disposed to be spaced apart from each other. Surfaces of the first connection vias 413 exposed from one surface 106 may be substantially coplanar with one surface 106. In a case in which one or more first connection vias 413 are exposed from the first surface 101, surfaces of the one or more first connection vias 413 exposed from the first surface 101 may be substantially coplanar with the first surface 101. The second connection via 423 connecting the second lead-out pattern 421 and the second auxiliary lead-out pattern 422 may be formed as a plurality in the second end portion 222 and disposed to be spaced apart from each other. The second connection via 423 connecting the second lead-out pattern 421 and the second auxiliary lead-out pattern 422 may be formed as a plurality in the second end portion 222 and disposed to be spaced apart from each other. Surfaces of the second connection vias 423 exposed from one surface 106 may be substantially coplanar with one surface 106. In a case in which one or more second connection vias 423 are exposed from the second surface 102, surfaces of the one or more second connection vias 423 exposed from the second surface 102 may be substantially coplanar with the second surface 102. At least two or more of each of the connection vias 413 and 423 may be exposed to the sixth surface 106 of the body 100 such that the exposed areas of each of the end portions 221 and 222 may be further reduced. Therefore, even when the end portions 221 and 222 are formed to have the same size, the exposed areas of the end portions 221 and 222 may be reduced to further reduce a plating time of the external electrode and make the thickness of a plating layer of the external electrode more uniform.

A sum of areas of each of the lead-out patterns 411 and 421, the auxiliary lead-out patterns 412 and 422, and the connection vias 413 and 423, exposed to the sixth surface 106 of the body 100, is greater than a sum of the area of the support substrate 200, exposed on the sixth surface 106 of the body 100. Since each of the lead-out patterns 411 and 421, the auxiliary lead-out patterns 412 and 422, and the connection vias 413 and 414 are conductors, a plating layer may be grown on each of the exposed surfaces, but since the support substrate 200 (specifically, the end portions 221 and 222) are non-conductors, a plating layer may not be grown from each of the exposed surfaces, and the plating layer grown from the surface of the conductor may extend only onto the exposed surfaces of the end portions 221 and 222. The exposed area of the conductor exposed to the sixth surface 106 of the body 100 is larger than the exposed area of the nonconductor disposed between the conductors and exposed on the sixth surface 106 of the body 100, such that the plating growth area may be larger than the plating extension area. As a result, it is possible to significantly reduce problems of appearance defects due to plating elongation and uneven thickness of the plating layer.

Each of the coil patterns 311 and 312, the via 320, the lead-out patterns 411 and 412, the auxiliary lead-out patterns 421 and 422, and the connection vias 413 and 423 may include at least one conductive layer. As an example, when the first coil pattern 311, the via 320, the first lead-out pattern 411, the second auxiliary lead-out pattern 422, and the first connection via 413 are formed on one surface of the support substrate 200 by plating, each of the first coil pattern 311, the via 320, the first lead-out pattern 411, the second auxiliary lead-out pattern 422, and the first connection via 413 may include a first conductive layer of a seed layer and a second conductive layer of an electroplating layer. The seed layer may be formed by a vapor deposition method such as electroless plating, sputtering, or the like. Each of the seed layer and the electroplating layer may have a monolayer structure or a multilayer structure. The electroplating layer with a multilayer structure may have a conformal film structure in which one electroplating layer is formed along a surface of the other electroplating layer, and may have a form in which one electroplating layer is only stacked on one side of the other electroplating layer. A seed layer of the first coil pattern 311 and a seed layer L1 of the first lead-out pattern 411 may be integrally formed, such that a boundary therebetween may not exist. The seed layer of the first coil pattern 311 and the seed layer of the via 320 may be integrally formed, such that a boundary therebetween may not exist, but an embodiment is not limited thereto. An electroplating layer of the first coil pattern 311, an electroplating layer of the via 320 may be integrally formed, so boundaries therebetween may not exist, but an embodiment is not limited thereto. The seed layer L1 of the first lead-out pattern 411 and the seed layer L3 of the first connection via 413 may be formed by a separate process so a boundary therebetween may be formed, or may be formed together in the same process and integrally formed. This will be described later in more detail.

Each of the coil patterns 311 and 312, the via 320, the lead-out patterns 411 and 421, the auxiliary lead-out patterns 412 and 422, and the connection vias 413 and 423 may be formed of a conductive material such as copper (Cu), aluminum (Al), silver (Ag), tin (Sn), gold (Au), nickel (Ni), lead (Pb), titanium (Ti), molybdenum (Mo), alloys thereof, but are not limited thereto. As an example, the seed layer L1 of the lead-out patterns 411 and 421 and the auxiliary lead-out patterns 412 and 422 may include molybdenum (Mo), and the seed layer L3 of the connection vias 413 and 423 may include copper (Cu), and electroplating layers L2 and L4 of each of the lead-out patterns 411 and 421, the auxiliary lead-out patterns 412 and 422, and the connection vias 413 and 423 may include copper (Cu), but is not limited thereto.

The first conductive layer L1 of each of the lead-out patterns 411 and 421 and the auxiliary lead-out patterns 412 and 422 may be disposed on one surface and the other surface of the support substrate 200 to cover both ends of the connection vias 413 and 423.

As an example, the first lead-out pattern 411 and the first auxiliary lead-out pattern 412 may be formed after forming the first connection via 413. Therefore, the seed layer L1 of the first lead-out pattern 411 may be formed on one surface of the first end portion 221 including one end of the first connection via 413 to cover one end of the first connection via 413. In addition, the seed layer L1 of the first auxiliary lead-out pattern 412 may be formed on the other surface of the first end portion 221 including the other end of the first connection via 413 to cover the other end of the first connection via 413. In this case, a boundary may be formed between the seed layer L3 of the first connection via 413 and the seed layer L1 of each of the first lead-out pattern 411 and the first auxiliary lead-out pattern 412. As a result, as illustrated in FIG. 5, the exposed surface of the first end portion 221 may be divided into a plurality of portions, and a line segment constituting the exposed surface of the first end portion 221 may be covered by the seed layers L1 and L3 of each of the first connection via 413, the first lead-out pattern 411, and the first auxiliary lead-out pattern 412, with respect to the sixth surface 106 of the body 100. In this case, two outermost vertical line segments of vertical line segments of the two exposed surfaces disposed on an outermost side with respect to the sixth surface 106 of the body 100 of the plurality of exposed surfaces may not be covered by the seed layers L1 and L3 of each of the first connection via 413, the first lead-out pattern 411, and the first auxiliary lead-out pattern 412. That is, the exposed surface disposed on the outermost side of the sixth surface 106 of the body 100 of the plurality of exposed surfaces of the first end portion 221 may be formed such that three line segments of four line segments consisting the exposed surface may be covered by the seed layers L1 and L3 of each of the first connection via 413, the first lead-out pattern 411, and the first auxiliary lead-out pattern 412. As a result of the first connection via 413 being exposed to the sixth surface 106 of the body 100, a boundary between the seed layer L3 of the first connection via 413 and the seed layer L1 of each of the first lead-out pattern 411 and the first auxiliary lead-out pattern 412 may be exposed to the sixth surface 106 of the body 100.

As another example, the first lead-out pattern 411 and the first auxiliary lead-out pattern 412 may be formed with the first connection via 413. Therefore, the seed layer L1 of the first lead-out pattern 411, the first auxiliary lead-out pattern 412, and the first connection via 413 may be integrally formed along a wall surface of a connection via hole of the first end portion 421 in which the first connection via 413 is disposed and one surface and the other surface of the first end portion 421. Further, an electroplating layer L2 of the first lead-out pattern 411, the first auxiliary lead-out pattern 412, and the first connection via 413 may be integrally formed on one surface and the other surface of the first end portion 421 while filling the connection via hole of the first end portion 421 in which the first connection via 413 is disposed. As a result, as illustrated in FIG. 6, the exposed surface of the first end portion 221 may be divided into a plurality of portions by the first connection via 413, with reference to the sixth surface 106 of the body 100, and the seed layer L1 of the first connection via 413, the first lead-out pattern 411, and the first auxiliary lead-out pattern 412 may be integrally formed along the line segment constituting the plurality of exposed surfaces of the first end portion 221. That is, the seed layer L1 of the first connection via 413, the first lead-out pattern 411, and the first auxiliary lead-out pattern 412 may be integrally formed along a line segment consisting any one of the exposed surfaces of the first end portion 421. In this case, outermost two vertical line segments of the vertical line segments of the two exposed surfaces disposed on an outermost side, with respect to the sixth surface 106 of the body 100 of the plurality of exposed surfaces may not be covered by the seed layer L1 of the first connection via 413, the first lead-out pattern 411, and the first auxiliary lead-out pattern 412.

Meanwhile, although it is described with reference to the first end portion 221, the first lead-out pattern 411, the first auxiliary lead-out pattern 412, and the first connection via 413 above, the same contents may also be applied to the second end portion 222, the second lead-out pattern 421, the second auxiliary lead-out pattern 422, and the second connection via 423. In addition, although it is described with reference to the sixth surface 106 of the body 100 above, as described above, since the first and second lead-out portions 410 and 420 are exposed to the first, second, and sixth surfaces 101, 102, and 106 of the body 100, the same contents may be applied to the first and second surfaces 101 and 102 of the body 100.

An insulating film 500 may be disposed between each of the support substrate 200, the coil portion 300, and the lead-out portions 410 and 420 and the body 100. In the present embodiment, the body 100 includes a magnetic metal powder, and the insulating film 500 electrically insulates the coil portion 300 and the lead-out portions 410 and 420 from the body 100. The insulating film 500 may be formed of parylene, and the like, but is not limited thereto.

The external electrode 610 and 620 may be disposed on one surface 106 of the body 100 to be spaced apart from each other, and may be connected to the first and second lead-out portions 410 and 420. The first external electrode 610 may be contacted with and connected to each of the first lead-out pattern 411, the first auxiliary lead-out pattern 412, and the first connection via 413, exposed to the sixth surface 106 of the body 100. The second external electrode 620 may be contacted with and connected to each of the second lead-out pattern 421, the second auxiliary lead-out pattern 422, and the second connection via 423, exposed to the sixth surface 106 of the body 100.

The external electrodes 610 and 620 may electrically connect the coil component 1000 to a printed circuit board, or the like, when the coil component 1000 according to the present embodiment is mounted on a printed circuit board, or the like. As an example, the coil component 1000 according to the present embodiment may be mounted such that the sixth surface 106 of the body 100 faces an upper surface of the printed circuit board. The external electrodes 610 and 620 may be disposed on the sixth surface 106 of the body 100 to be spaced apart from each other, such that the connection portion of the printed circuit board may be electrically connected to each other.

The external electrodes 610 and 620 may include at least one of a conductive resin layer and an electroplating layer. The conductive resin layer may be formed by printing a conductive paste on the surface of the body 100 and curing the conductive paste. The conductive paste may include any one or more conductive metal selected from a group consisting of copper (Cu), nickel (Ni), and silver (Ag) and a thermosetting resin. The electroplating layer may include any one or more selected from a group consisting of nickel (Ni), copper (Cu), and tin (Sn). In the present embodiment, the external electrodes 610 and 620 may include a first plating layer 10 formed on the surface of the body 100 to be in direct contact with the lead-out portions 410 and 420 and a second plating layer 20 disposed in the first plating layer 10, respectively. As an example, the first plating layer 10 may be a nickel (Ni) plating layer, and the second plating layer 20 may be a tin (Sn) plating layer, but is not limited thereto. As another example, the first plating layer 10 may be a copper (Cu) plating layer, and the second plating layer 20 may have a two-layer structure of a nickel (Ni) plating layer and a tin (Sn) plating layer.

As set forth above, according to the present disclosure, external electrodes may be formed relatively uniformly on the body surface by plating.

According to the aforementioned example embodiments, as it may not be necessary to specify the surface on which the external electrode is formed, costs and time for manufacturing a coil component may reduce.

While the exemplary embodiments have been shown and described above, it will be apparent to those skilled in the art that modifications and variations could be made without departing from the scope of the present invention as defined by the appended claims.

What is claimed is:

1. A coil component, comprising:

a coil portion embedded in a body;

first and second lead-out portions connected to both ends of the coil portion, respectively, and exposed from one surface of the body, the first and second lead-out portions spaced apart from each other; and a support substrate embedded in the body to support the coil portion and the first and second lead-out portions, and exposed from the one surface of the body, wherein each of the first and second lead-out portions comprises a lead-out pattern and an auxiliary lead-out pattern disposed on one surface and another surface of the support substrate, opposing each other in one direction, and exposed from the one surface of the body, respectively, and a connection via penetrating through the support substrate to connect the lead-out pattern and the auxiliary lead-out pattern is exposed from the one surface of the body, and in the one direction, the lead-out pattern and the auxiliary lead-out pattern overlap with the connection via of the first and second lead-out portions and a portion of the support substrate directly surrounding the connection via of the first and second lead-out portions except where the connection via of the first and second lead-out portions is exposed for the one surface of the body.

2. The coil component of claim 1, wherein, each of the lead-out pattern and the auxiliary lead-out pattern is exposed from the one surface of the body with a length corresponding to a portion of the support substrate exposed from the one surface.

3. The coil component of claim 1, wherein a sum of areas of each of the lead-out pattern, the auxiliary lead-out pattern, and the connection via, exposed from the one surface of the body, is larger than a sum of an area of the support substrate exposed from the one surface of the body.

4. The coil component of claim 1, wherein each of the lead-out pattern, the auxiliary lead-out pattern, and the connection via comprises a first conductive layer disposed on the support substrate and a second conductive layer disposed on the first conductive layer.

5. The coil component of claim 4, wherein the first conductive layer of each of the lead-out pattern and the auxiliary lead-out pattern is disposed on the one surface and the another surface of the support substrate and covers both ends of the connection via.

6. The coil component of claim 4, wherein the first conductive layer of each of the lead-out pattern, the auxiliary lead-out pattern, and the connection via is integrally formed along an inner wall of a connection via hole of the support substrate in which the connection via is disposed, and the one surface and the another surface of the support substrate.

7. The coil component of claim 4, wherein the connection via includes a plurality of connection vias, and at least two or more of the plurality of connection vias are exposed from one surface of the body and spaced apart from each other.

8. The coil component of claim 7, wherein the support substrate has a plurality of exposed surfaces spaced apart from each other by the plurality of connection vias, based on the one surface of the body, and a line segment constituting the plurality of exposed surfaces of the support substrate is covered with the first conductive layer of each of the plurality of connection vias, the lead-out pattern, and the auxiliary lead-out pattern.

9. The coil component of claim 8, wherein a boundary between each of the first conductive layer of the lead-out pattern and the auxiliary lead-out pattern and the first conductive layer of the plurality of connection vias is exposed from the one surface of the body.

10. The coil component of claim 8, wherein each of the first conductive layer of the lead-out pattern and the auxiliary lead-out pattern and the first conductive layer of the plurality of connection vias are integrally formed along a line segment constituting each of the plurality of exposed surfaces of the support substrate.

11. The coil component of claim 1, wherein the body has one end surface and another end surface connected to the one surface of the body and opposing each other, the first and second lead-out portions are exposed to extend from the one surface of the body to the one end surface of the body and the another end surface of the body, respectively, and the connection via is exposed from the one surface of the body, the one end surface of the body, and the another end surface of the body, respectively.

12. The coil component of claim 1, wherein a surface of the connection via of the first lead-out portion exposed from the one surface is substantially coplanar with the one surface, and a surface of the connection via of the second lead-out portion exposed from the one surface is substantially coplanar with the one surface.

13. The coil component of claim 1, further comprising:

a first external electrode disposed on the one surface of the body and connected the lead-out pattern, the auxiliary lead-out pattern, and the connection via of the first lead-out portion; and a second external electrode disposed on the one surface of the body and connected the lead-out pattern, the auxiliary lead-out pattern, and the connection via of the second lead-out portion.

14. A coil component, comprising:

a coil portion embedded in a body;

a lead-out portion connected to an end of the coil portion, and exposed from one surface of the body; and a support substrate supporting the coil portion, including an end portion exposed from the one surface of the body and supporting the lead-out portion, wherein the lead-out portion comprises:

a lead-out pattern and an auxiliary lead-out pattern corresponding to the end portion, respectively, and disposed on both surfaces of the end portion, respectively, the lead-out pattern and the auxiliary lead-out pattern opposing each other, and a plurality of connection vias penetrating through the end portion, respectively, and connecting the lead-out pattern and the auxiliary lead-out pattern to each other, wherein the lead-out pattern and the auxiliary lead-out pattern respectively cover first ends and second ends of the plurality of connection vias opposing each other, on the one surface of the body, the lead-out pattern includes one continuous surface extending between the first ends of the plurality of connection vias, and the auxiliary lead-out pattern includes one continuous surface extending between the second ends of the plurality of connection vias, and the plurality of connection vias are exposed from the one surface and an end surface of the body extending from the one surface.

15. The coil component of claim 14, wherein a seed layer of the lead-out pattern covers the first ends of the plurality of connection vias, and a seed layer of the auxiliary lead-out pattern covers the second ends of the plurality of connection vias.

16. The coil component of claim 14, wherein the end portion has a plurality of exposed surfaces spaced apart from each other by the plurality of connection vias, with reference to the one surface of the body, and a seed layer of each of the lead-out pattern, the auxiliary lead-out pattern, and the plurality of connection vias is integrally formed along at least three of more line segments consisting any one of the plurality of exposed surfaces of the end portion, with reference to the one surface of the body.

17. The coil component of claim 14, wherein surfaces of the plurality of connection vias exposed from the one surface are substantially coplanar with the one surface, and surfaces of the plurality of connection vias exposed from the end surface are substantially coplanar with the end surface.

18. The coil component of claim 14, further comprising an external electrode disposed on the one surface and the end surface and connected to the lead-out pattern, the auxiliary lead-out pattern, and the plurality of connection vias.

19. A coil component, comprising:

a coil portion embedded in a body;

first and second lead-out portions connected to both ends of the coil portion, respectively, and exposed from one surface of the body, the first and second lead-out portions spaced apart from each other; and a support substrate embedded in the body to support the coil portion and the first and second lead-out portions, and exposed from the one surface of the body, wherein each of the first and second lead-out portions comprises a lead-out pattern and an auxiliary lead-out pattern disposed on one surface and another surface of the support substrate, opposing each other, and exposed from the one surface of the body, respectively, and a connection via penetrating through the support substrate to connect the lead-out pattern and the auxiliary lead-out pattern and exposed from the one surface of the body, each of the lead-out pattern, the auxiliary lead-out pattern, and the connection via comprises a first conductive layer disposed on the support substrate and a second conductive layer disposed on the first conductive layer, and the first conductive layer of each of the lead-out pattern and the auxiliary lead-out pattern is disposed on the one surface and the another surface of the support substrate and covers both ends of the connection via.

* * * * *